US011013295B2

(12) United States Patent
Huffman et al.

(10) Patent No.: US 11,013,295 B2
(45) Date of Patent: May 25, 2021

(54) SOCKLINER ASSEMBLIES FOR ARTICLES OF FOOTWEAR

(71) Applicant: NIKE, Inc., Beaverton, OR (US)

(72) Inventors: Julie A. Huffman, Portland, OR (US); Todd A. Waatti, Battle Ground, WA (US)

(73) Assignee: NIKE, Inc., Beaverton, OR (US)

( * ) Notice: Subject to any disclaimer, the term of this patent is extended or adjusted under 35 U.S.C. 154(b) by 92 days.

(21) Appl. No.: 16/205,867

(22) Filed: Nov. 30, 2018

(65) Prior Publication Data

US 2020/0170347 A1 Jun. 4, 2020

(51) Int. Cl.

| | |
|---|---|
| ***A43B 7/14*** | (2006.01) |
| ***A43B 19/00*** | (2006.01) |
| ***A43B 7/28*** | (2006.01) |
| ***A43C 9/00*** | (2006.01) |
| ***A43B 13/38*** | (2006.01) |
| ***A43B 17/00*** | (2006.01) |

(52) U.S. Cl.

CPC ..... *A43B 19/00* (2013.01); *A43B 7/1485* (2013.01); *A43B 7/28* (2013.01); *A43B 13/38* (2013.01); *A43B 17/00* (2013.01); *A43C 9/00* (2013.01)

(58) Field of Classification Search

CPC ..... A43B 13/38; A43B 13/386; A43B 17/00; A43B 17/18; A43B 17/14; A43B 17/1495

USPC ..... 36/50.1, 88, 91, 93, 145, 166, 169, 170

See application file for complete search history.

(56) References Cited

U.S. PATENT DOCUMENTS

| | | | | |
|---|---|---|---|---|
| 1,572,213 | A * | 2/1926 | Lucas | A43B 3/0052 36/170 |
| 1,976,819 | A * | 10/1934 | Weiler | A43B 7/1495 36/166 |
| 2,539,761 | A * | 1/1951 | Whitman | A43C 1/00 36/114 |
| 4,794,706 | A * | 1/1989 | Puckhaber | A43B 3/26 36/91 |
| 4,860,464 | A * | 8/1989 | Misevich | A43B 7/1495 36/114 |
| 5,291,671 | A | 3/1994 | Caberlotto et al. | |
| 7,346,936 | B2 | 3/2008 | Vargas et al. | |
| 8,117,770 | B2 | 2/2012 | Wong | |
| 8,146,273 | B2 * | 4/2012 | Sokolowski | A43B 7/1495 36/96 |

(Continued)

FOREIGN PATENT DOCUMENTS

GB 2508204 A 5/2014

OTHER PUBLICATIONS

International Search Report and Written Opinion mailed in International Application No. PCT/US2019/063235, dated Mar. 6, 2020, 14 pages.

*Primary Examiner* — Marie D Bays

(74) *Attorney, Agent, or Firm* — Klarquist Sparkman, LLP

(57) ABSTRACT

A sockliner assembly can comprise a sockliner and one or more cables. The sockliner can have an upper surface, a lower surface, and a side surface extending between the upper and lower surfaces and defining a peripheral edge of the sockliner. The first cable can have a first attached cable segment and a first free cable segment. The first attached cable segment can be coupled to the sockliner. The first free cable segment can extend from the first attached cable segment and can extend beyond the peripheral edge of the sockliner.

12 Claims, 9 Drawing Sheets

(56) References Cited

U.S. PATENT DOCUMENTS

| | | | | |
|---|---|---|---|---|
| 9,005,710 | B2 * | 4/2015 | Jones | A43D 11/00 427/288 |
| 9,060,567 | B2 * | 6/2015 | Elder | A43B 7/1495 |
| 9,113,675 | B2 | 8/2015 | DeHaven et al. | |
| 9,420,851 | B2 * | 8/2016 | Klug | A43C 1/00 |
| 9,491,983 | B2 * | 11/2016 | Rushbrook | A43B 13/16 |
| 9,861,162 | B2 * | 1/2018 | Kilgore | A43B 23/0235 |
| 10,136,701 | B2 * | 11/2018 | Klein | A43B 23/025 |
| 10,645,990 | B2 * | 5/2020 | Rushbrook | A43B 3/26 |
| 2004/0181972 | A1 * | 9/2004 | Csorba | A43C 11/14 36/50.1 |
| 2005/0055844 | A1 | 3/2005 | Yu | |
| 2006/0117606 | A1 * | 6/2006 | Chen | A43C 1/04 36/50.1 |
| 2007/0011914 | A1 * | 1/2007 | Keen | A43C 11/00 36/50.1 |
| 2010/0154256 | A1 * | 6/2010 | Dua | A43B 1/04 36/25 R |
| 2012/0011744 | A1 * | 1/2012 | Bell | A43B 23/07 36/91 |
| 2012/0192451 | A1 | 8/2012 | Fujikura | |
| 2012/0192452 | A1 | 8/2012 | Lewis et al. | |
| 2013/0192091 | A1 * | 8/2013 | Kohatsu | A43B 23/026 36/103 |
| 2014/0130370 | A1 | 5/2014 | Knudson et al. | |
| 2014/0202042 | A1 | 7/2014 | Berend et al. | |
| 2014/0259787 | A1 | 9/2014 | Guyan et al. | |
| 2015/0000157 | A1 | 1/2015 | Hikichi | |
| 2015/0165690 | A1 | 6/2015 | Tow | |
| 2015/0193560 | A1 | 7/2015 | Spector | |
| 2016/0015126 | A1 * | 1/2016 | Farris | A43B 23/0245 36/88 |
| 2016/0302530 | A1 * | 10/2016 | Smith | A43B 17/02 |
| 2018/0020774 | A1 | 1/2018 | Chang | |
| 2018/0343966 | A1 * | 12/2018 | Cook | A43B 7/24 |
| 2019/0053570 | A1 * | 2/2019 | Fortener | A43B 19/00 |

* cited by examiner

SOCKLINER ASSEMBLIES FOR ARTICLES OF FOOTWEAR

FIELD

This disclosure relates generally to sockliner assemblies for use with articles of footwear.

BACKGROUND

Articles of footwear typically include a sole structure and an upper coupled to the sole structure. The upper forms an interior void configured to receive a foot of a wearer. A sockliner (which can also be referred to as an "insole") is inserted into the interior void and disposed between the sole structure and the wearer's foot.

DETAILED DESCRIPTION

General Considerations

Figure 1:
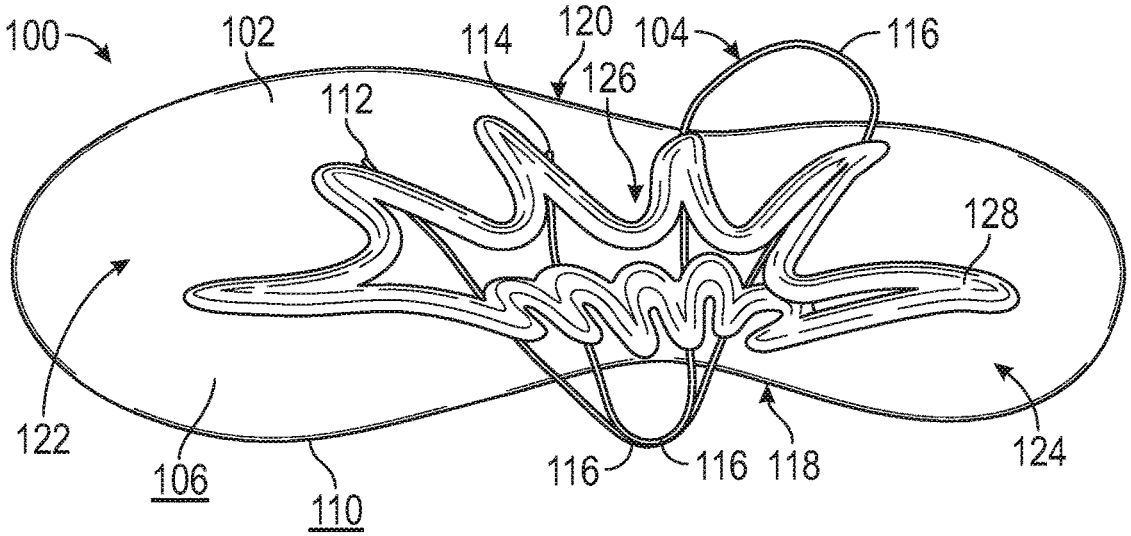
FIG. 1 depicts a bottom plan view of an exemplary embodiment of a sockliner assembly.

For purposes of this description, certain aspects, advantages, and novel features of the embodiments of this disclosure are described herein. The described methods, systems, and apparatus should not be construed as limiting in any way. Features, characteristics, and/or groups described in conjunction with a particular aspect, embodiment or example are to be understood to be applicable to any other aspect, embodiment or example described herein unless incompatible therewith. All of the features disclosed in this specification (including any accompanying claims, abstract, and drawings), and/or all of the steps of any method or process so disclosed, may be combined in any combination, except combinations where at least some of such features and/or steps are mutually exclusive. The disclosure is not restricted to the details of any foregoing embodiments. The disclosure extends to any novel one, or any novel combination, of the features disclosed in this specification (including any accompanying claims, abstract, and drawings), or to any novel one, or any novel combination, of the steps of any method or process so disclosed.

Although the operations of some of the disclosed methods are described in a particular, sequential order for convenient presentation, it should be understood that this manner of description encompasses rearrangement, unless a particular ordering is required by specific language set forth below. For example, operations described sequentially may in some cases be rearranged or performed concurrently. Moreover, for the sake of simplicity, the attached figures may not show the various ways in which the disclosed methods, systems, and apparatus can be used in conjunction with other systems, methods, and apparatus.

The explanations of terms and abbreviations herein are provided to better describe the present disclosure and to guide those of ordinary skill in the art in the practice of the present disclosure. As used herein, "comprising" means "including" and the singular forms "a" or "an" or "the" include plural references unless the context clearly dictates otherwise. The term "or" refers to a single element of stated alternative elements or a combination of two or more elements, unless the context clearly indicates otherwise.

As used herein, the term "and/or" used between the last two of a list of elements means any one of, or any combination of, the listed elements. For example, the phrase "A, B, and/or C" means "A," "B," "C," "A and B," "A and C," "B and C," or "A, B, and C."

As used herein, the term "exemplary" means serving as a non-limiting example, instance, or illustration. As used herein, the terms "e.g.," and "for example," introduce a list of one or more non-limiting embodiments, examples, instances, and/or illustrations.

As used herein, the terms "attached" and "coupled" generally mean physically connected or linked, which includes items that are directly attached/coupled and items that are attached/coupled with intermediate elements between the attached/coupled items, unless specifically stated to the contrary.

As used herein, the directional terms (e.g., "upper" and "lower") generally correspond to the orientation of a sockliner assembly or an article of footwear as it is configured to be worn by a wearer. For example, an "upwardly-facing surface" and/or an "upper surface" of a sockliner assembly refers to the surface oriented in the "superior" or "cranial" anatomical direction (i.e., toward the head end of a body) when the sockliner assembly is being worn by the wearer. Similarly, the directional terms "downwardly" and/or "lower" refer to the anatomical direction "inferior" or "caudal" (i.e., away from the head). "Front" means "anterior," and "back" means "posterior." "Medial" means "toward the midline of the body," and "lateral" means "away from the midline of the body."

Also, as used herein, the terms "printing" or "printed," and "depositing" or "deposited," are each used synonymously, and are intended to refer to the association of a material from a source of the material to a receiving surface or object.

Unless explained otherwise, all technical and scientific terms used herein have the same meaning as commonly understood to one of ordinary skill in the art to which this disclosure belongs. Although methods and materials similar or equivalent to those described herein can be used in the practice or testing of the present disclosure, suitable methods and materials are described below. The materials, methods, and examples are illustrative only and not intended to be limiting. Other features of the disclosure are apparent from the detailed description, claims, abstract, and drawings.

Introduction to the Disclosed Technology

Articles of footwear (also referred to herein as "articles") can include running shoes, soccer shoes, football shoes, rugby shoes, basketball shoes, baseball shoes, tennis shoes, sneakers, boots, sandals, and other types of footwear.

Articles of footwear typically include a sole structure and an upper coupled to the sole structure. The upper forms an interior void configured to receive a foot of a wearer. A sockliner is inserted into the interior void and disposed between the sole structure and the wearer's foot and the sole structure.

In some instances, the sockliner can be non-destructively removable from the article, or in other words, the sockliner can be removed without damaging the sockliner and/or other portions of the article. In other instances, at least a portion of the sockliner can be permanently attached to the article.

With typical sockliners, the bottom of a wearer's foot may contact only a portion of the sockliner during use. For example, the wearer's forefoot (e.g., the ball and toes) and heel may contact the sockliner, but the wearer's arch may be spaced apart from the sockliner. This can, for example, make the sockliner feel unsupportive, uncomfortable, and/or like it doesn't properly fit the wearer's foot. Also, the contact area between the wearer's foot and the sockliner can vary as the wearer's foot moves. For example, much of a wearer's foot may contact the sockliner while the wearer's foot is in contact with the ground, but most of the wearer's foot may separate from the sockliner while the wearer's foot is airborne. This contact/non-contact relative motion between the wearer's foot and the sockliner can, for example, cause skin irritation (e.g., blisters) and/or generate heat.

Disclosed herein are sockliner assemblies for articles of footwear. A sockliner assembly can comprise a sockliner and cables (also called "strands") and/or straps (also called "tabs"). The cables and/or straps are attached to and extend from the sockliner. Tension in cables or straps can be adjusted to draw the sockliner against a wearer's foot and retain the sockliner in contact with the wearer's foot, even as the wearer moves. In this manner, the sockliner assembly can form a hammock-like structure that cradles the wearer's foot.

Accordingly, the disclosed sockliner assemblies can, in some embodiments, provide improved support, comfort, customization, and/or performance compared to typical sockliners. The disclosed sockliner assemblies can, in some embodiments, also reduce skin irritation and/or heat generated by friction between a wearer's foot and a sockliner.

Also disclosed herein are exemplary methods for forming sockliner assemblies for articles of footwear. These methods can include using a 3-D printer to secure cables or straps to a sockliner and/or using a 3-D printer to form guide structures on the sockliner for receiving and/or directing the cables.

The features and benefits of the disclosed technology will become more apparent in connection with the embodiments described below and shown in the drawings.

Exemplary Embodiments of Sockliner Assemblies and Articles of Footwear

In one representative embodiment, a sockliner assembly can include a sockliner and one or more cables. The sockliner can have an upper surface, a lower surface, and a side surface extending between the upper and lower surfaces and defining a peripheral edge of the sockliner. The first cable can have a first attached cable segment and a first free cable segment. The first attached cable segment can be coupled to the sockliner. The first free cable segment can extend from the first attached cable segment and can extend beyond the peripheral edge of the sockliner.

In another representative embodiment, an article of footwear is disclosed. The article of footwear can include an upper, a sole structure, and a sockliner assembly. The upper can include an interior void for receiving a foot. The sole structure can be coupled to the upper. The sockliner assembly can be dimensioned to fit within the interior void and can be positioned adjacent to the sole structure. The sockliner assembly can include a sockliner and one or more cables and/or straps coupled to the sockliner. The sockliner can have an upper surface facing the interior void, an opposing lower surface facing the sole structure, and a peripheral edge defining the sockliner. In some embodiments, the sockliner assembly can include a first cable with a first attached cable segment and a first free cable segment extending from the first attached cable segment. The first attached cable segment is coupled to the sockliner. The first free cable segment is movable relative to the sockliner, and at least a portion of the first free cable segment extends beyond the peripheral edge of the sockliner.

Figure 2:
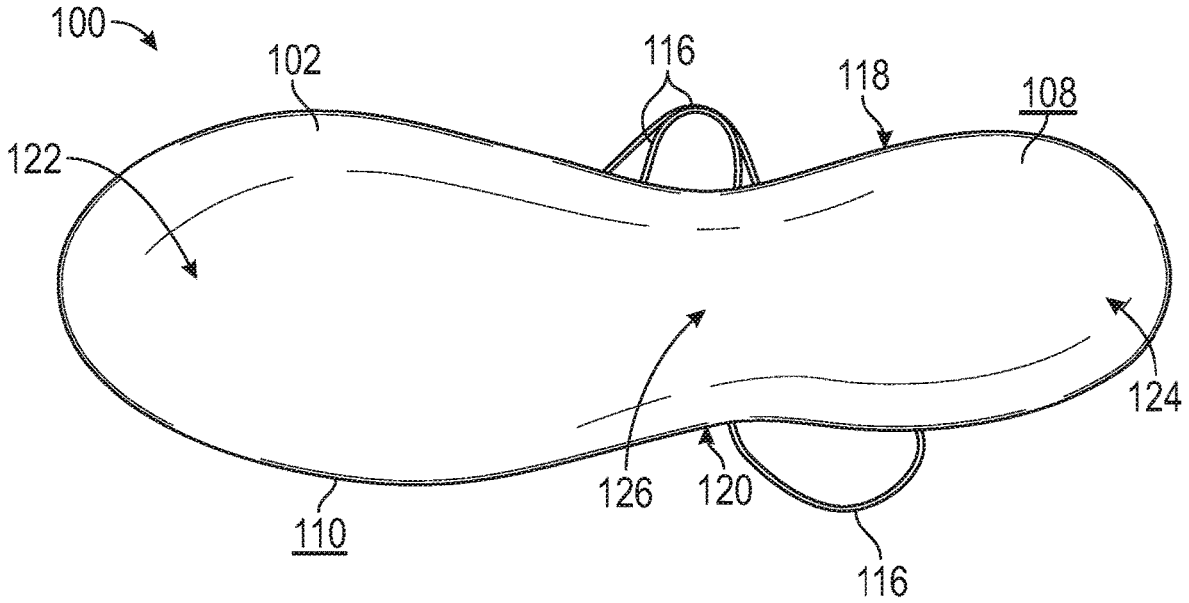
FIG. 2 depicts a top plan view of the sockliner assembly of FIG. 1.
Figure 4:
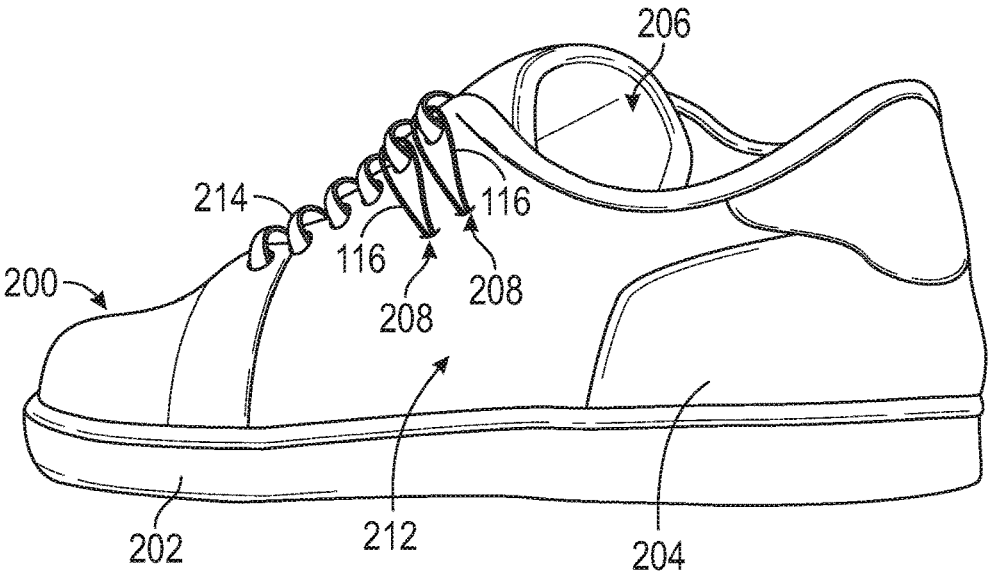
FIG. 4 depicts a perspective view of the sockliner assembly of FIG. 1 together with the article of footwear, according to one embodiment.
Figure 5A:
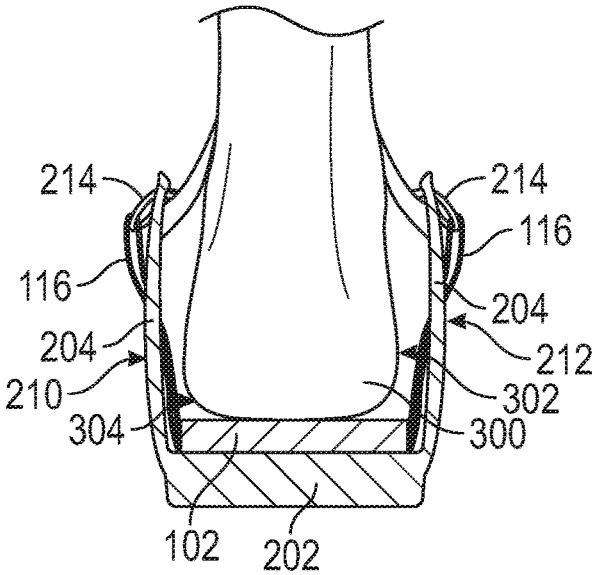
FIG. 5A depicts a cross-sectional view of the sockliner assembly of FIG. 1 and the article of footwear, showing a foot inserted into the article of footwear and the sockliner assembly in a first configuration.
Figure 5B:
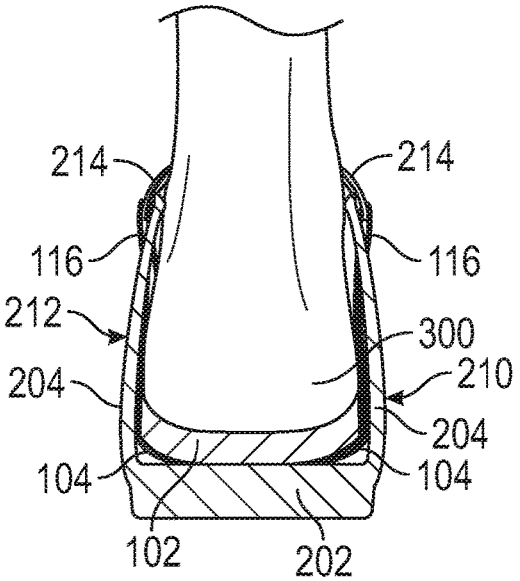
FIG. 5B depicts a cross-sectional view of the sockliner assembly of FIG. 1 and the article of footwear, showing a foot inserted into the article of footwear and the sockliner assembly in a second configuration.

FIGS. 1-2 show an exemplary embodiment of a sockliner assembly 100 comprising a sockliner 102 and one cable 104 coupled to and extending from the sockliner 102. As shown in FIGS. 3-5B, the sockliner assembly 100 can be inserted into an article of footwear. The sockliner assembly 100 can cushion and/or support a wearer's foot. Tension of the cable 104 of the sockliner assembly 100 can be adjusted (e.g., via a lace of the article) to secure and/or conform the sockliner 102 of the sockliner assembly 100 to a wearer's foot, as shown in FIGS. 5A-5B. In this manner, the sockliner assembly 100 can cradle and thus support the wearer's foot throughout a full range of movements and/or activities. As such, the sockliner assembly 100 can, for example, provide an article of footwear with a comfortable and consistent fit. Additional details regarding the sockliner assembly 100 and exemplary articles of footwear are provided below.

Referring again to FIGS. 1-2 and as mentioned above, the sockliner assembly 100 can comprise two main components:

the sockliner 102 and the cable 104, as mentioned above. The sockliner 102 can be a relatively thin, flexible pad or insert that can be disposed within an article of footwear between the wearer's foot and a sole structure of an article of footwear and can provide support and/or cushioning to a wearer's foot. The cable 104 can be a relatively thin, flexible strand or cord coupled to and extending from the sockliner 102. The cable 104 can support and/or suspend sockliner and can draw the sockliner into contact with the wearer's foot. The cable 104 can also allow the sockliner 102 to be adjusted and/or conformed relative to the wearer's foot.

The sockliner 102 (which may also be referred to as an "insole") can be shaped generally like a bottom of a foot and can include a lower surface 106, an upper surface 108, and a side surface 110. The side surface 110 can define a peripheral edge of the sockliner 102. The sockliner 102 can include one or more layers of material and can be formed from one or more natural or synthetic materials such as foam, rubber, polymer, fabric, leather, etc. For example, in some embodiments, a sockliner can be formed from ethylene vinyl acetate ("EVA"), polyethylene vinyl acetate ("PEVA"), polyurethane ("PU"), thermoplastic polyurethane ("TPU"), and/or nitrile butadiene rubber ("NBR").

In some embodiments, the sockliner can be formed from a relatively elastic material (e.g., EVA or NBR) such that it can stretch in one or more directions during ordinary use. In other embodiments, the sockliner can be formed from a relatively inelastic material (e.g., polycarbonate ("PC")) such that it does not stretch in one or more directions during ordinary use.

The sockliner assembly 100 can have one or more cables. For example, in the illustrated embodiment, the sockliner assembly 100 has one cable 104. In other embodiments, the sockliner assembly 100 can have more than one cable (e.g., 2-12) (see, e.g., FIG. 8, which shows a sockliner assembly with three cables 404).

A cable of the sockliner assembly can form one or more loops, which can be used to couple the cable to an article of footwear, as further described below. As shown in FIG. 1, the sockliner assembly 100 comprises one cable 104, and the cable 104 forms three loops 116. The cable 104 has a first end portion 112, a second end portion 114, and an intermediate portion extending between the first and second end portions 112, 114. The first and second end portions 112, 114 of the cable 104 are coupled to the lower surface 106 of the sockliner 102 and form first and second attached cable segments, respectively. The intermediate portion of the cable 104 winds back and forth across the sockliner 102 in a serpentine manner. Some sections of the intermediate portion of the cable 104 are also secured to the sockliner 102 and form additional attached cable segments. Other sections of the intermediate portion of the cable 104 are unsecured to the sockliner 102 and form free cable segments. One or more of the free cable segments can extend beyond the peripheral edge of the sockliner 102 and form the loops 116. For example, the free cable segments of the illustrated embodiment form three loops 116 in the cable 104, with two of the loops 116 extending beyond the medial side 118 of the sockliner 102, and one of the loops 116 extending beyond the lateral side 120 of the sockliner 102.

As noted above, in other embodiments, a sockliner assembly can have more than one cable (e.g., 2-12 cables). Also, each cable can have one or more loops or free segments (e.g., 1-12). For example, in some embodiments, a sockliner assembly can have a first cable forming a first loop on a medial side of the sockliner, a second cable forming second loop on the medial side of the sockliner, and a third cable forming a third loop on a lateral side of the sockliner. In other embodiments, a sockliner assembly can have a first cable and a first loop on a medial side of the sockliner and a second cable and a second loop on a lateral side of the sockliner. In other embodiments, a sockliner assembly can have one or more loops or free segments on only one side of the sockliner (e.g., one loop on a medial side or two loops on a lateral side).

As an alternative to forming a loop by attaching the first and second end portions of the cable to the sockliner, the cable can have a first end portion secured to the sockliner, and a second end portion of the cable can be unsecured from the sockliner and extend beyond the peripheral edge of the sockliner. In other words, the second end portion of the cable is a free cable segment. In one more or such embodiments, the second end portion of the cable can have an eyelet formed therein or coupled thereto. The eyelet can be configured for receiving a lace of an article or for coupling the cable to the article in another way.

A cable can be coupled to the one or more surfaces of a sockliner and by various means. For example, in the illustrated embodiment, the cable 104 is coupled to the lower surface 106 of the sockliner 102 using printed material 128 (see FIG. 1). In lieu of or in addition to the lower surface 106, the cable can be coupled to one or more other surfaces of the sockliner 102, such as the upper surface 108 and/or a side surface 110. In lieu of or in addition to the printed material 128, the cable 104 can be coupled to the sockliner 102 with adhesive, fasteners, stitching, and/or other means for coupling. Additional details regarding coupling a cable to a sockliner with printed material are provided below (see, e.g., FIGS. 14A-15B).

In some embodiments, a surface of the sockliner 102 to which the cable 104 is attached (e.g., the lower surface 106) can have one or more recessed portions configured to receive the cable 104. The recesses and the cables can be sized and/or configured such that the cable is flush with the surface of the sockliner when the cable is attached to the sockliner. This can, for example, improve the comfort of the sockliner assembly under the wearer's foot and/or improve the connection between the sockliner and the cable.

A cable of a sockliner assembly can have various cross-sectional profiles. For example, in the illustrated embodiment, the cable 104 has a rounded (e.g., circular, ovular) cross-sectional profile. In other embodiments, a cable can comprise other cross-sectional profiles (e.g., rectangular). Also, in some embodiments, a cable can have more than one cross-sectional profile along its length. For example, the segments of the cable that are coupled to and/or disposed under the sockliner (e.g., the first and second end portions 112, 114 of the cable 104) can have a thin, flat cross-sectional profile (e.g., rectangular) to improve the comfort of the cable under the wearer's foot, and the free cable segments (e.g., the loops 116 of the cable 104) can have a rounded cross-sectional profile to facilitate relative movement (e.g., sliding) between the free cable segment and a lace of an article.

Figure 3:
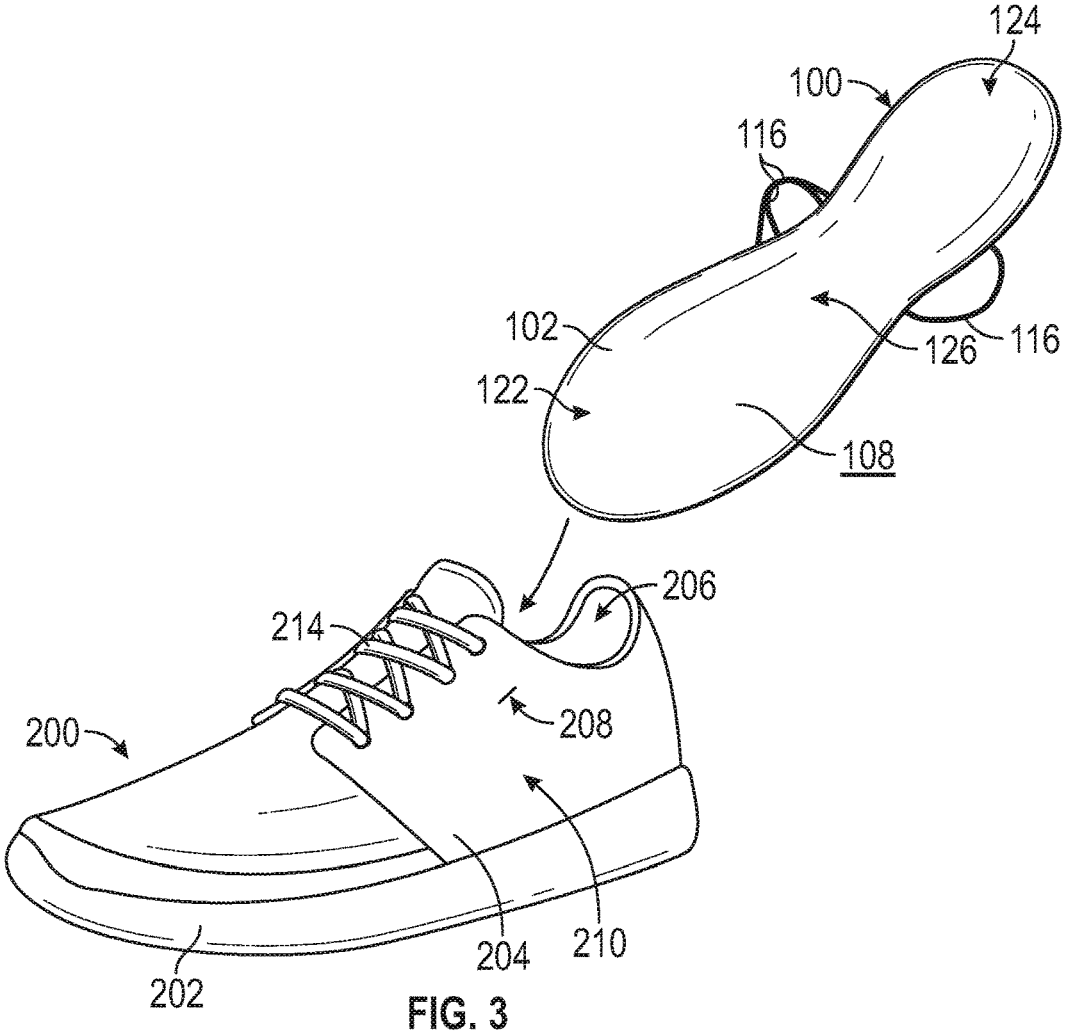
FIG. 3 depicts a perspective view of the sockliner assembly of FIG. 1 being inserted into an exemplary article of footwear.

FIG. 3 shows the sockliner assembly 100 being inserted into an exemplary article of footwear 200 (also referred to as the "article 200"). The assembled article 200 can comprise a sole structure 202, an upper 204, and the sockliner assembly 100. The upper 204 can be coupled to the sole structure 202 so as to form an interior void 206 for receiving a foot between the sole structure 202 and the upper 204. The sockliner assembly 100 can be inserted into the interior void 206 of the article 200 and can be positioned adjacent an upwardly facing surface of the sole structure 202.

The sockliner assembly can be coupled to other portions of the article in various ways. For example, in some instances, the sockliner assembly can be coupled to other portions of the article such that the sockliner assembly is non-destructively removable from the article. In other instances, the sockliner assembly can be permanently secured to other portions of the article.

In non-destructively removable embodiments, the sockliner assembly can be removed from the article without damaging the sockliner assembly or the article. This allows for the sockliner assembly to move relative to the sole structure so that it can conform to the wearer's foot. It also allows the sockliner assembly to be removed (e.g., for cleaning) and/or inserted (e.g., into another article of footwear) if desired.

For example, as shown in the illustrated embodiment, the sockliner 102 can be movable relative to the sole structure 202 of the article 200, and the loops 116 of the sockliner assembly 100 can be releasably connected to an adjustment system (e.g., laces, straps, etc.) of the article 200. In some embodiments, the upper 204 of the article 200 can have one or more openings 208 formed therein to allow the loops 116 of the sockliner assembly 100 to exit and/or re-enter the upper 204. For example, as shown in FIG. 3, a lateral side 210 of the upper 204 has one opening 208 for receiving the loop 116 on the lateral side 120 of the sockliner assembly 100, and as shown in FIG. 4, a medial side 212 of the upper 204 has two openings 208 for receiving the loops 116 on the medial side 118 of the sockliner assembly 100.

In some embodiments, a free cable segment of a cable can exit and re-enter an upper of an article through one opening in the upper. For example, as shown in FIGS. 4 and 5A, each free cable segment of the cable 104 (which comprises a loop 116) extends from the sockliner 102, extends along an interior side of the upper 204 of the article 200 (i.e., between a foot 300 of the wearer and the upper 204), exits the upper through a respective opening 208 of the upper 204, extends along an exterior side of the upper 204, extends around the lace 214, extends along an exterior side of the upper 204, re-enters the upper 204 through the respective opening 208, and extends back to the sockliner 102.

Figure 6:
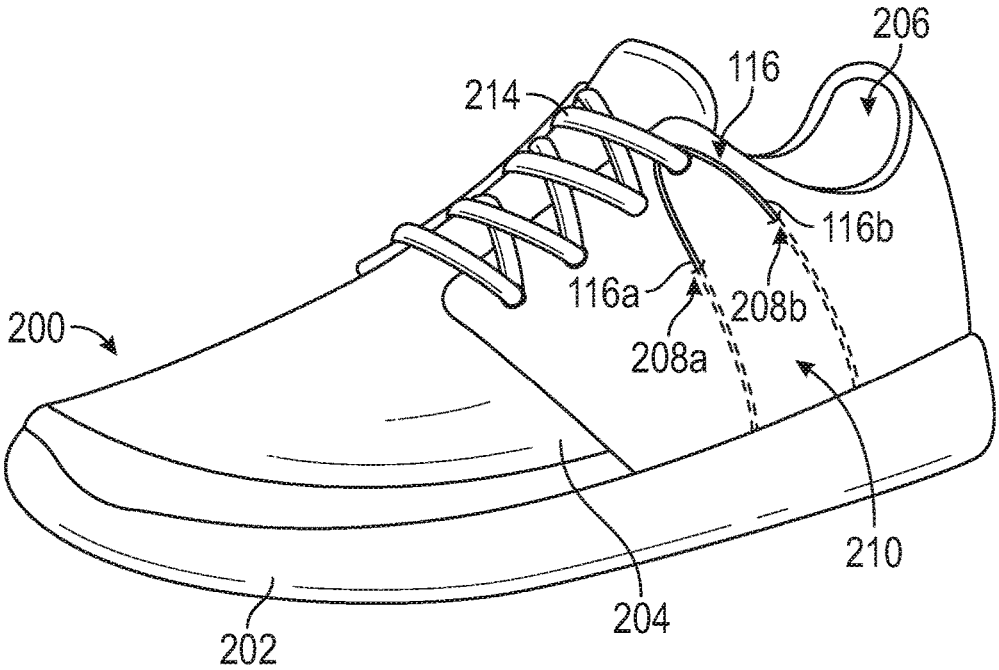
FIG. 6 depicts a perspective view of the sockliner assembly of FIG. 1 together with the article of footwear, according to another embodiment.

In other embodiments, a cable can extend through the upper via multiple openings. For example, as shown in FIG. 6, a first side 116*a* of the loop 116 extends through a first opening 208*a* of the upper 204, and a second side 116*b* of the loop 116 extends through a second opening 208*b* of the upper 204.

Figure 7:
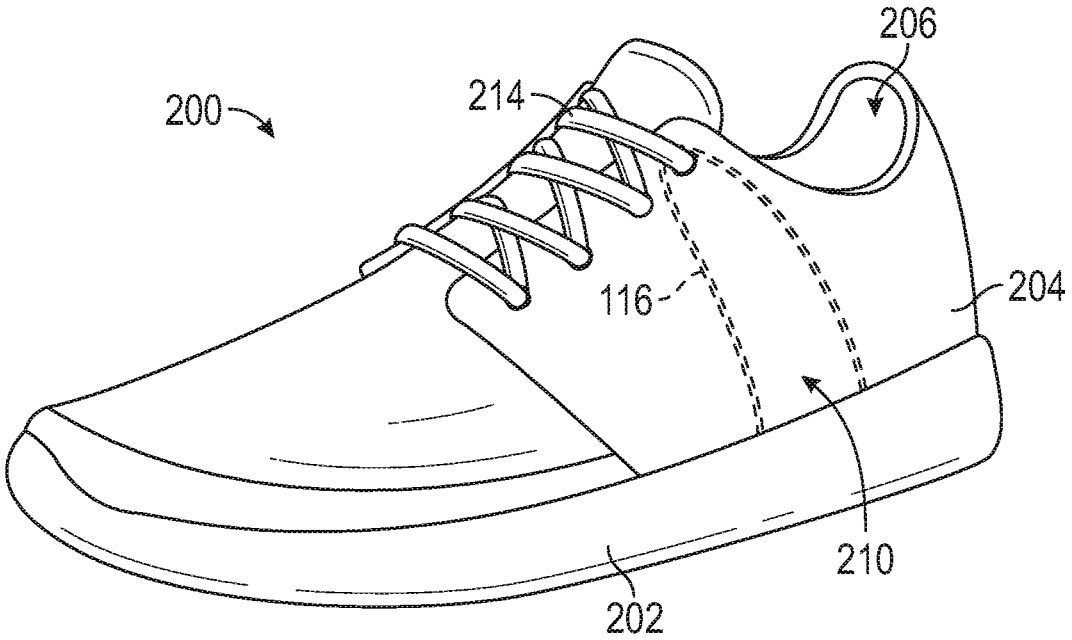
FIG. 7 depicts a perspective view of the sockliner assembly of FIG. 1 together with the article of footwear, according to yet another embodiment.

In other embodiments, as shown in FIG. 7, the upper 204 can be formed without openings for the cable 104. In some such embodiments, the loops 116 of the cable 104 can remain on the interior side of the upper 204 as the loops 116 extend from the sockliner 102 (FIG. 1), wrap around the lace 214, and return to the sockliner 102.

In other embodiments, the loops of the sockliner assembly 100 can be removably coupled to the interior side of the upper via an attachment member such as a hook, eyelet, and/or other means for removable attachment. In some such embodiments, the cables can be formed of an elastic material that can be stretched from a relaxed configuration to a stretched configuration. In the relaxed configuration, at least a portion of the sockliner (e.g., the midfoot portion) can be suspended and spaced apart from the sole structure of the article. The weight of the wearer's foot on the sockliner can cause the cables to elastically deform and the sockliner to move downwardly toward the sole structure of the article. The bias of the cables to the relaxed configuration can retain the sockliner against the wearer's foot and/or conform the sockliner to the shape of the wearer's foot.

In permanently attached embodiments, at least a portion of the sockliner assembly can be permanently secured to the article. This prevents the secured portions of the sockliner assembly from moving relative to the sole structure. For example, in some embodiments, a forefoot portion 122 and/or a heel portion 124 of the sockliner 102 can be secured to the sole structure of the article to prevent movement (e.g., slippage between the sockliner and the sole structure of the article). This can be accomplished with adhesive, stitching, fasteners, etc. An arch or midfoot portion 126 of the sockliner 102 can be unsecured to the sole structure 202. This can allow the midfoot portion 126 of the sockliner 102 to conform to and cradle the arch of the wearer's foot.

In another permanently attached embodiment, a portion of a cable of the sockliner assembly can be secured to the upper (e.g., via stitching, fasteners, adhesive, etc.). In such embodiments, the cables can be formed of an elastic material as described above.

The fit of the sockliner assembly 100 and/or pressure exerted by the sockliner assembly on the wearer's foot can be adjusted in various ways. For example, the sockliner assembly 100 can be adjusted between a loose or untensioned configuration to a tight or tensioned configuration by adjusting the tension of the cable 104. FIG. 5A shows one exemplary loose configuration, and FIG. 5B shows one exemplary tight configuration. The tension of the cable 104 can be adjusted to various degrees by the wearer to achieve a desired fit.

In the loose configuration of FIG. 5A, the cable 104 is slackened and as a result the sockliner 102 rests flat against the upper surface of the sole structure 202 of the article 200. The sockliner 102 also gapes away from the wearer's foot 300 on the medial and lateral sides 302, 304 of the wearer's foot. This loose configured can be achieved by slackening the lace 214 of the article 200, and it can facilitate entry and exit of the wearer's foot.

The wearer can move the sockliner assembly 100 from the loose configuration (FIG. 5A) to the tight configuration (FIG. 5B) by tightening the lace 214 of the article 200. This pulls the cable 104 of the sockliner assembly 100 upwardly and away from the sole structure 202 of the article 200 and moves the sockliner 102 upwardly against the bottom of the wearer's foot 300. As a result, the sockliner assembly 100 cradles the wearer's foot in a hammock-like manner. In the tensioned configuration, the sockliner 102 can remain in contact with the bottom of wearer's foot as the wearer's foot moves.

Additionally or alternatively, the length of the loops can also be selected by the wearer to achieve a desired fit. For example, long loops will provide low tension in the cable and result in a relaxed fit of the sockliner. Short loops will provide high tension in the cable and result in an active fit.

The tension of a cable can also be adjusted by altering the size and/or material of the cable. For example, a large diameter cable and/or a cable with a high modulus of elasticity will provide high tension in the cable, and a small diameter cable and/or a cable with a low modulus of elasticity will provide low tension in the cable.

Figure 16:
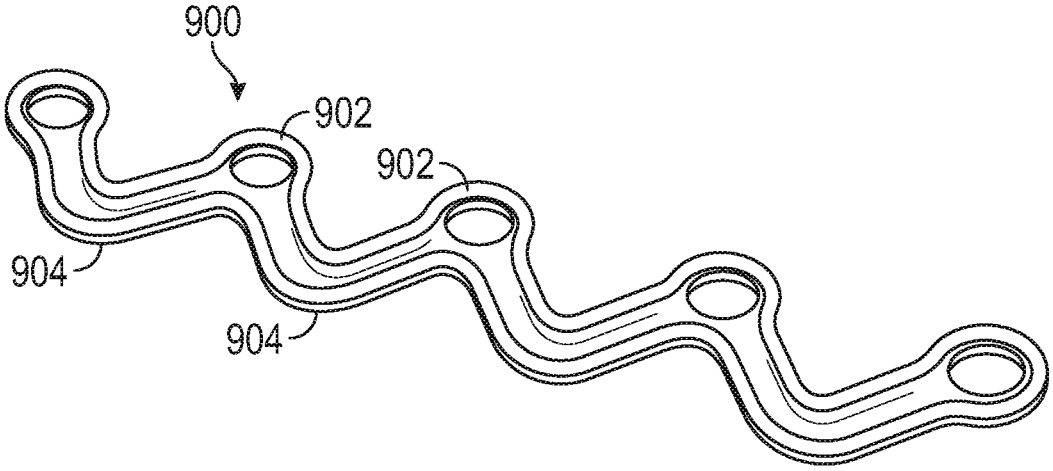
FIG. 16 depicts a perspective view of an exemplary cable connector.
Figure 17:
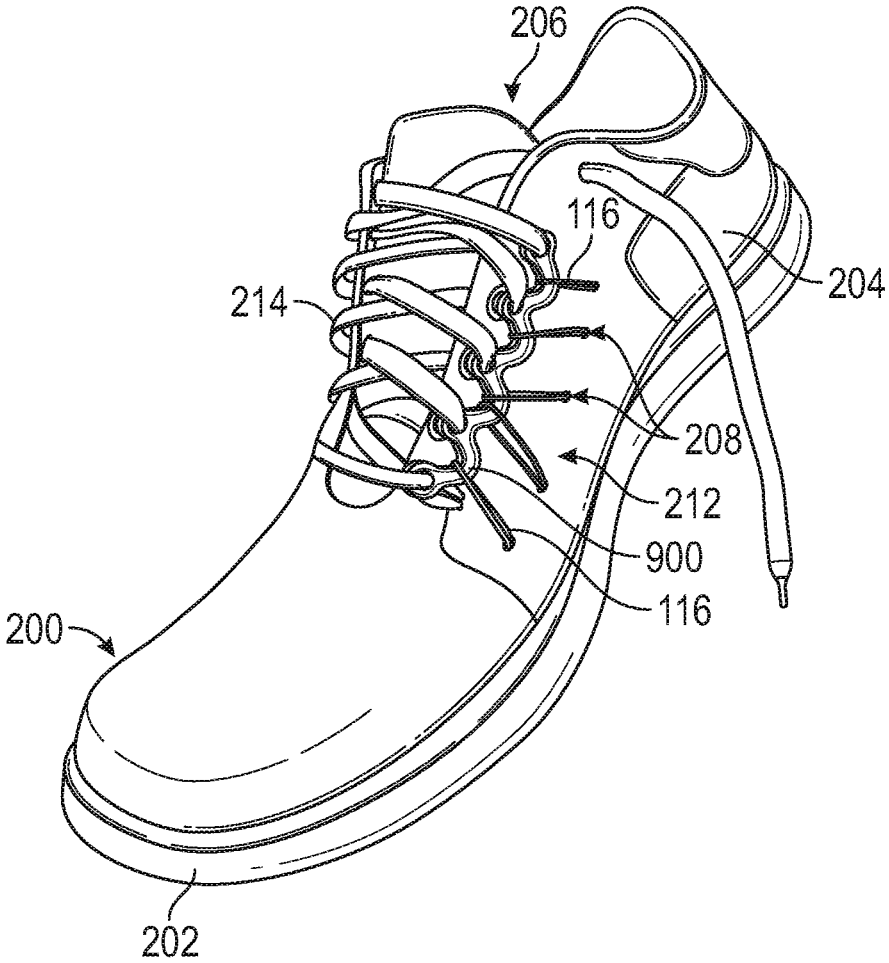
FIG. 17 depicts a perspective view of the cable connector of FIG. 16 being used with the sockliner assembly of FIG. 1 and the article of footwear of FIG. 3.

In some embodiments, a cable connector can optionally be used to adjust the tension of the cable of the sockliner assembly and/or to couple a sockliner assembly to an article. For example, FIGS. 16-17 show an exemplary embodiment of a cable connector 900. As shown in FIG. 17, the cable connector 900 can be coupled to the lace 214 of the article 200 and to the loops 116 of the sockliner assembly 100. The cable connector adjusts the tension of the cable 104 (FIG. 1) by moving the loops 116 of the sockliner assembly 100 from the laces 214 of the article 200 to the cable connector 900 (e.g., reducing tension in the illustrated embodiment).

A cable connector can include one or more attachment portions for securing the cable connector to an article and one or more support portions for receiving the cables of the sockliner assembly. For example, as shown in FIG. 16, the cable connector 900 comprises five attachment portions (e.g., eyelets 902) and four support portions (e.g., links 904) extending between the support portions. As shown in FIG. 17, the cable connector 900 can be inserted through the loops 116 of the sockliner assembly such that the loops 116 are disposed on the links 904 of the cable connector 900, and the lace 214 of the article 200 can be inserted through the eyelets 902 of the cable connector 900.

A cable connector can include more or fewer eyelets and/or links than shown in the illustrated embodiment. Also, the number of eyelets of the cable connector can be different than the number of lace eyelets of an article to which the cable connector is attached. For example, a cable connector can have three eyelets and two links, and/or the article can have more than three lace eyelets.

The size and/or configuration of the cable connectors 900 can be adjusted to provide a desired fit of the sockliner assembly. For example, the extent to which the links 904 of the cable connector 900 extend from eyelets 902 of the cable connector 900 affects the tension of the cables of the sockliner assembly. For example, configuring the links 904 of the cable connector 900 such that the links 904 extend farther away from the eyelets 902 of the cable connector 900 (and the laces 214) toward to sole structure 202 of the article 200 results in relatively less cable tension and thus a more relaxed fit for the sockliner 102 (FIG. 1) relative to the wearer's foot. As another example, configuring the links 904 of the cable connector 900 such that the links 904 extend farther away from the eyelets 902 of the cable connector 900 (and the laces 214) toward to tongue of the article 200 results in relatively more cable tension and thus a more secure fit for the sockliner 102 relative to the wearer's foot.

In the illustrated embodiment, the links 904 of the cable connector are generally "U"-shaped. In other embodiments, the links 904 can comprise various other shapes such as "V"-shaped or straight.

In the illustrated embodiment, the cable connector 900 is removably coupled to the laces 214 of the article 200 via the eyelets 902. As a result, a wearer can remove and/or exchange the cable connector 900 for a cable connector providing different cable tension. This allows the wearer to customize the fit of the sockliner assembly and/or article as desired. In other embodiments, a cable connector can be fixed relative to an article such that the cable connector cannot be non-destructively removed.

In lieu of or in addition to connecting the cable or a strap of a sockliner assembly (e.g., the cable 104 or the strap 510) to an upper of an article, a cable connector can be used to couple one or more other strands of the article to the upper. For example, an article can include one or more stabilizer strands coupled to and extending from a sole structure, and the stabilizer strands can be coupled to the cable connector. The stabilizer stands can, for example, be configured for providing additional medial/lateral stability to the article.

A cable connector can be formed of a relatively flexible material such that it can flex with the upper of an article. Also, in some embodiments, the cable connector can be formed of a material that is relatively equal or less elastic material than the cables of the sockliner assembly such that it tends not to stretch as tension is applied to the cables.

Figure 8:
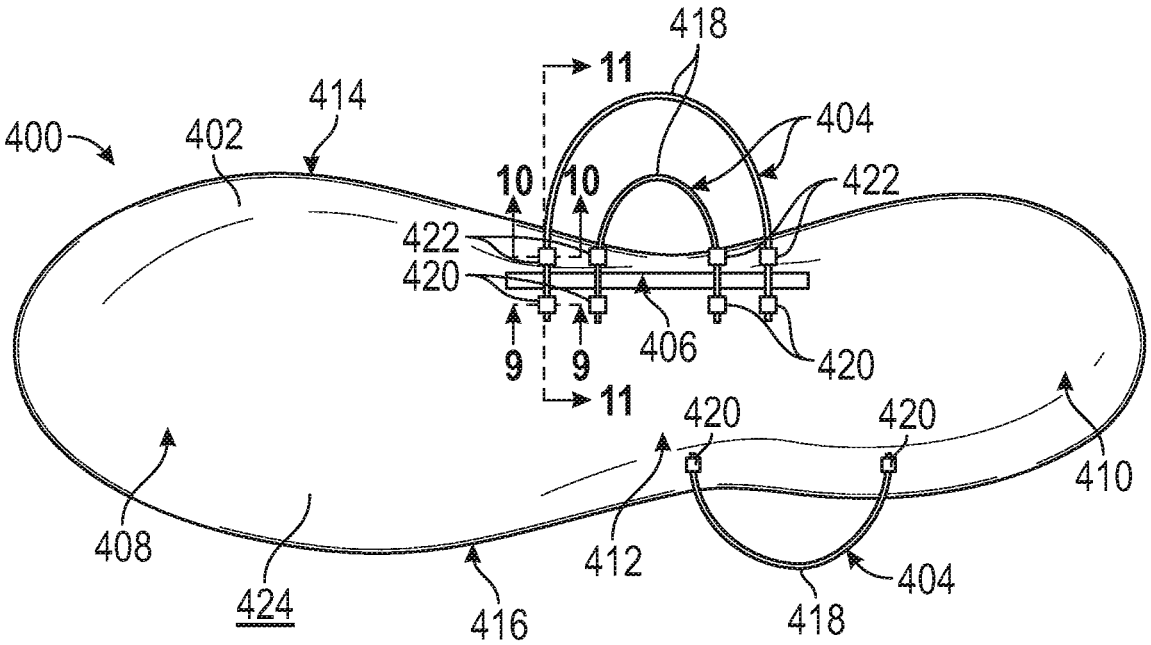
FIG. 8 depicts a bottom plan view of another exemplary embodiment of a sockliner assembly.

In some embodiments, a sockliner of a sockliner assembly can be formed with one or more openings. The openings can, for example, facilitate flexing and/or conformity of the sockliner around a wearer's foot. For example, FIG. 8 shows an exemplary sockliner assembly 400 comprising a sockliner 402 having an opening 406 formed therein. The sockliner assembly 400 also comprises three cables 404. Generally speaking, the sockliner 402 and the cables 404 of the sockliner assembly 400 can be configured in a manner similar to the sockliner 102 and the cable 104 of the sockliner assembly 100.

The sockliner 402 has a forefoot portion 408, a heel portion 410, a midfoot portion 412, a medial side portion 414, and a lateral side portion 416. In the illustrated embodiment, the sockliner 402 has one opening 406 disposed in the midfoot portion 412 and toward the medial side portion 414. In other embodiments, the sockliner can have more than one opening (e.g., 2-12), and/or the opening(s) can be disposed at other locations of the sockliner (e.g., on the lateral side portion).

In the illustrated embodiment, the opening 406 of the sockliner 402 has a generally rectangular shape. In other embodiments, the opening can comprise various shapes, including elliptical, crescent, arcuate, circular, etc. The size (e.g., length, width, diameter, etc.) of the opening can also be altered.

The sockliner assembly depicted in FIG. 8 has three cables 404, each forming a loop 418. In other embodiments, the sockliner assembly can have less or more than three cables (e.g., 1-2 or 4-12 cables), and each cable can form one or more loops.

The cables 404 can be coupled to the sockliner 402 in various ways including using printed material, adhesive, fasteners, stitching, and/or other means for coupling. For example, the cables 404 can be fixedly coupled to the sockliner 402 with one or more attachment structures 420 and/or movably coupled to the sockliner 402 with one or more guide structures 422, as shown in FIG. 8. The cables 404 cannot move relative to their respective attachment structures 420 and the sockliner 402 but can move relative to their respective guide structures 422 and the sockliner 402.

Figure 9:
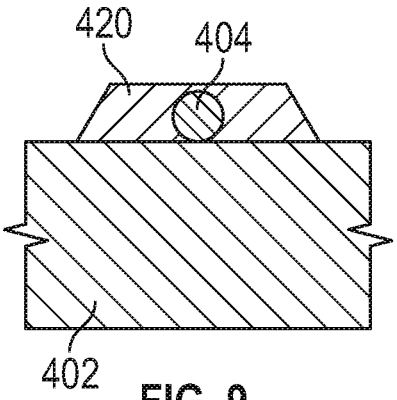
FIG. 9 depicts a cross-sectional view of an attachment structure of the sockliner assembly of FIG. 8, taken along the line 9-9 as shown in FIG. 8.
Figure 10:
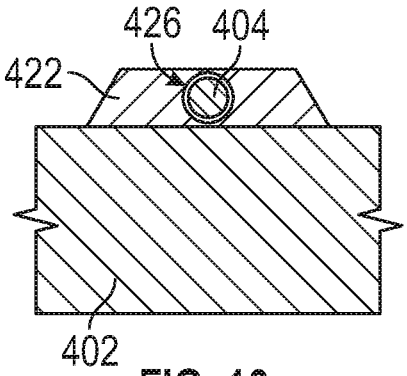
FIG. 10 depicts a cross-sectional view of a guide structure of the sockliner assembly of FIG. 8, taken along the line 10-10 as shown in FIG. 8.

FIGS. 9 and 10 show cross-sectional views of an attachment structure 420 and a guide structure 422, respectively. The attachment structures 420 and guide structures 422 can be fixedly coupled to a bottom surface 424 of the sockliner 402. The attachment structures 420 can also be fixedly coupled to portions of the cables 404. These fixed couplings can be accomplished in various ways including fasteners, stitching, adhesive, etc. In some instances, the structures 420, 422 can be formed of a printed material that is deposited directly onto the sockliner 402 and/or over the cables 404. Additional information regarding printing the structures 420, 422 directly onto the sockliner and/or cables is provided below.

Figure 11A:
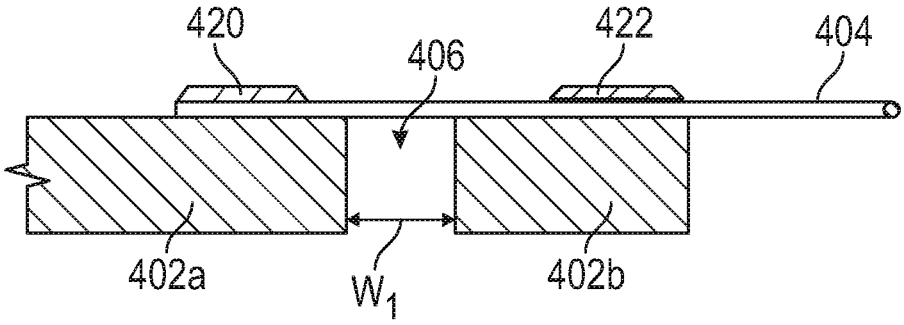
FIG. 11A depicts a partial cross-sectional view of the sockliner assembly of FIG. 8, taken along the line 11-11 as shown in FIG. 8 and showing the sockliner assembly in a relaxed configuration.
Figure 11B:
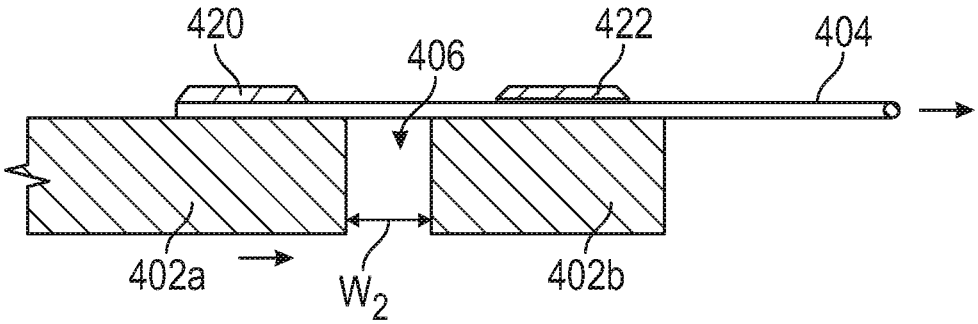
FIG. 11B depicts a partial cross-sectional view of the sockliner assembly of FIG. 8, taken along the line 11-11 as shown in FIG. 8 and showing the sockliner assembly in a stretched configuration.

In some embodiments, the sockliner 402 can be formed of a material that can be elastically deformed (e.g., stretched) when tension is applied to the cables 404. For example, referring now to FIG. 11A, the sockliner 402 can be configured such that the opening 406 has a first width $W_1$ when the cable 404 is in a relaxed, non-tensed configuration. When tension is applied to the cables 404, a first portion 402*a* of the sockliner 402 to which the attachment structure 420 is attached stretches and moves toward a second portion 402*b* of the sockliner 402 to which the guide structure 422 is attached. Also, the cable 404 translates through a passageway or lumen 426 (FIG. 10) of the guide structure 422. As a result, the width of the opening 406 is reduced from $W_1$ to $W_2$. In some instances, the sockliner can be stretched until the two portions of the sockliner contact each other, effectively closing the opening of the sockliner.

Figure 12:
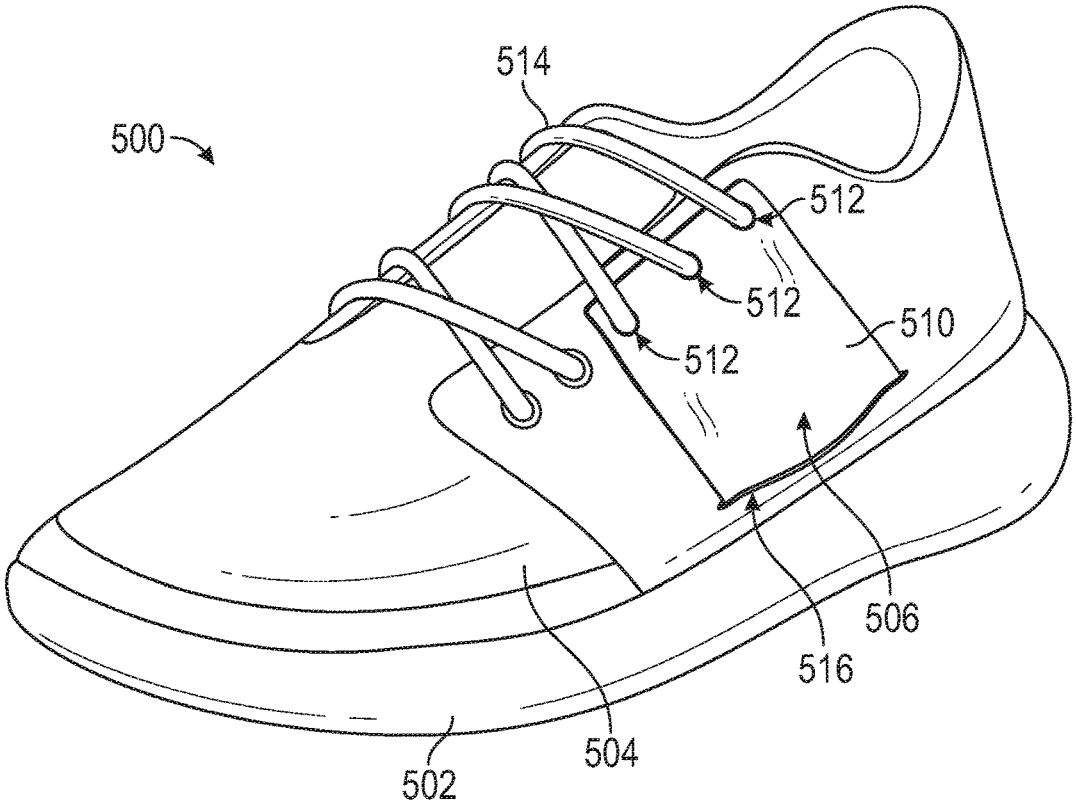
FIG. 12 depicts perspective view of another exemplary sockliner assembly together with an article of footwear, according to one embodiment.

FIG. 12 shows an article of footwear 500 having another exemplary sockliner assembly. The article 500 can comprise a sole structure 502, an upper 504, and a sockliner assembly 506 disposed at least partially within a void between the upper 504 and the sole structure 502.

Figure 13:
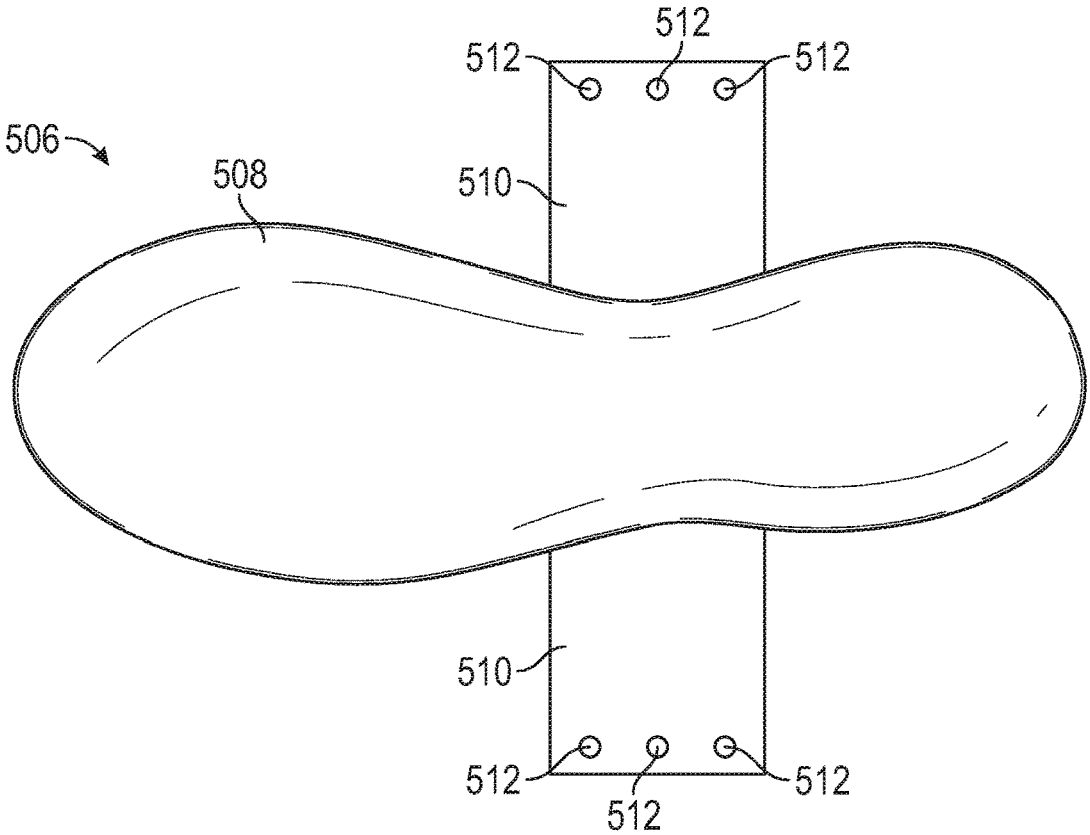
FIG. 13 depicts a top plan view of the sockliner assembly of FIG. 12.

Referring to FIG. 13, the sockliner assembly 506 of the article 500, like the other sockliner assemblies disclosed herein, comprises a sockliner 508 that can conform to and/or support a wearer's foot. Compared to the sockliner assemblies 100 and 400, however, the sockliner assembly 506 has two relatively wide, flexible tabs or straps 510 coupled to and extending from the sockliner 508 rather than one or more relatively thin, flexible cables (see, e.g., the cable 104 of the sockliner assembly 100).

As shown in FIG. 13, the sockliner assembly 506 can include a first strap on a medial side of the sockliner 508 and a second strap on a lateral side of the sockliner 508. In other embodiments, the sockliner assembly 506 can have one strap (e.g., on either the medial side or the lateral side of the sockliner) or more than two straps (e.g. 3-4). Also, in some embodiments, a sockliner assembly can comprise one or more straps (e.g., straps 510) in addition to one or more cables (e.g., the cable 104). The straps and cables can both extend from the same side of the sockliner (e.g., the medial side) or can be on opposing sides of the sockliner (e.g., cables on the medial side and straps on the lateral side, or vice versa).

In some embodiments, the straps 510 of the sockliner assembly 506 can be coupled to the sockliner such as with adhesive, stitching, fasteners, etc. In other embodiments, the straps 510 can be integrally formed with the sockliner. This can be accomplished, for example, by molding or 3-D printing the sockliner and the straps 510 as a single, unitary component. It can also be accomplished by forming (e.g., cutting) the sockliner and the strap from a single piece of material (e.g., leather).

Tension of the straps 510 can be adjusted by various means. For example, as shown in FIG. 12, the straps 510 can include one or more eyelets 512 configured for receiving a lace 514, a strap, and/or other adjustment member of the article 500.

As shown in FIG. 12, in some embodiments, the upper 504 of the article 500 can have an opening or slot 516 formed therein and configured such that the straps 510 of the sockliner assembly 506 can extend from the interior side of the upper 504 to the exterior side of the upper 504. In other embodiments, the upper 504 can be formed without a slot, and the straps 510 of the sockliner assembly 506 can remain on the interior side of the upper 504.

The sockliner assemblies disclosed herein can, for example, provide improved comfort, support, customized fit, and/or performance compared to typical sockliners from which a wearer's foot separates during activity. The disclosed sockliner assemblies can also reduce heat and skin irritation (e.g., blistering) because there is less relative movement and thus less friction between the wearer's foot and the sockliner.

Exemplary Methods of forming Sockliner Assemblies and Articles of Footwear

Also disclosed herein are exemplary methods for forming sockliner assemblies for articles of footwear. These methods can include using a 3-D printer to secure cables or straps to a sockliner and/or using a 3-D printer to form cable guides on the sockliner for receiving the cables.

In one representative embodiment, a method of forming a sockliner assembly can include: positioning a cable so that a first cable portion of the cable contacts a surface of a sockliner, printing a print material onto the first cable portion and the sockliner, and curing the print material to attach the first cable portion to the sockliner.

Figure 14A:
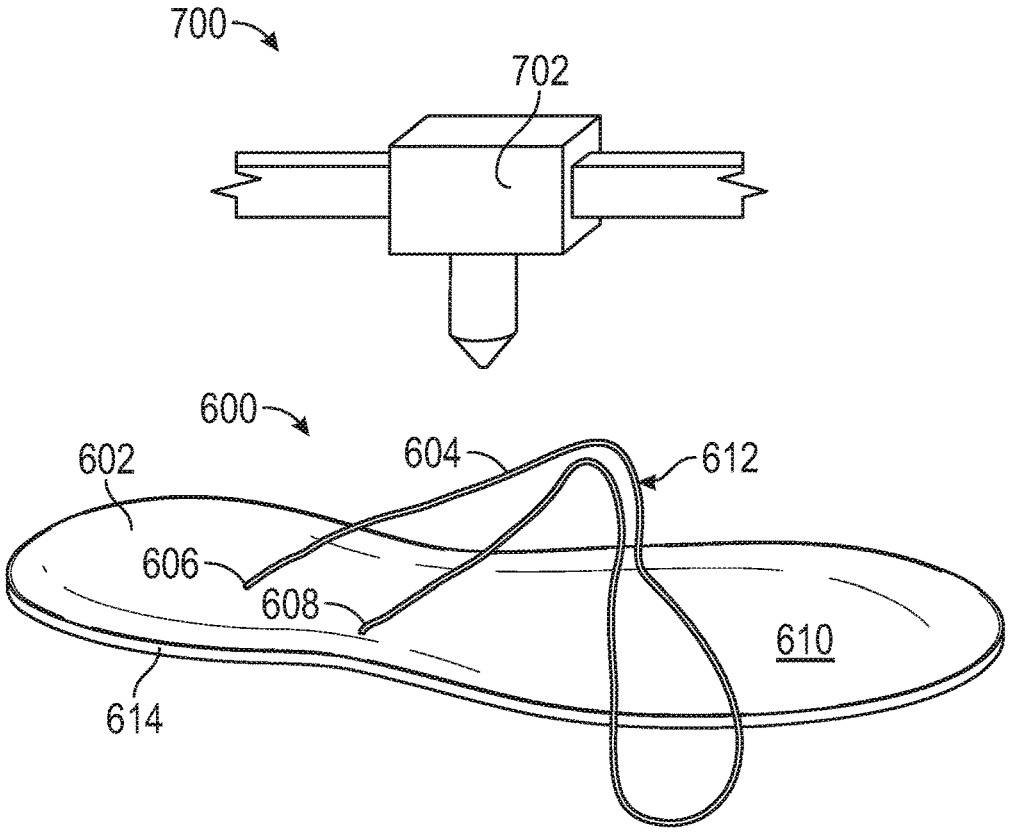
FIGS. 14A-14B depict an exemplary method of forming a sockliner assembly.
Figure 14B:
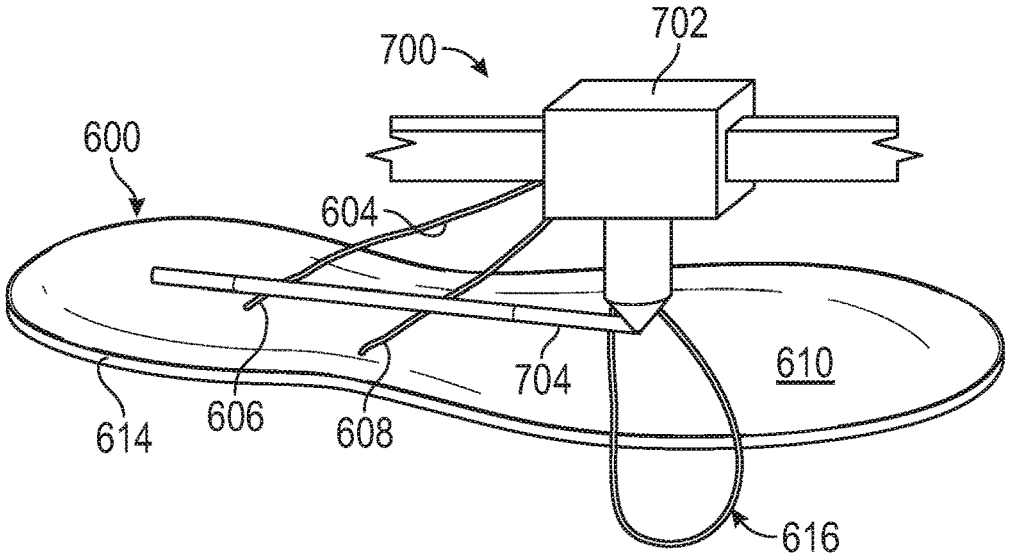

For example, FIGS. 14A-14B depict an exemplary method of forming a sockliner assembly 600, which is like the sockliner assembly 100, by printing material onto the sockliner assembly. The sockliner assembly 600 can comprise a sockliner 602 and one or more cables 604 coupled to the sockliner 602.

The method can comprise positioning a cable 604 on a sockliner 602. Referring to FIG. 14A, the cable 604 can be arranged such that end portions 606, 608 of the cable 604 are disposed on a surface 610 (e.g., a bottom surface) of the sockliner 602 and such that intermediate portions 612 of the cable 604 extend beyond a peripheral edge 614 of the sockliner 602. As shown in FIG. 14B, a printing device 700 comprising a print head 702 can be used to deposit a print material 704 directly onto the sockliner assembly 600 to secure the cables 604 relative to the sockliner 602. When secured to the sockliner 602 in this manner, the cables 604 form loops 616.

In some instances, the attachment structures 420 of the sockliner assembly 400 can be formed using the method described above and depicted in FIGS. 14A-14B.

In another representative embodiment, a method of forming a sockliner assembly can include depositing a print material onto a surface of a sockliner, the print material forming a guide structure, and the guide structure including a passageway. The method can further include inserting a cable through the passageway of the guide structure.

Figure 15A:
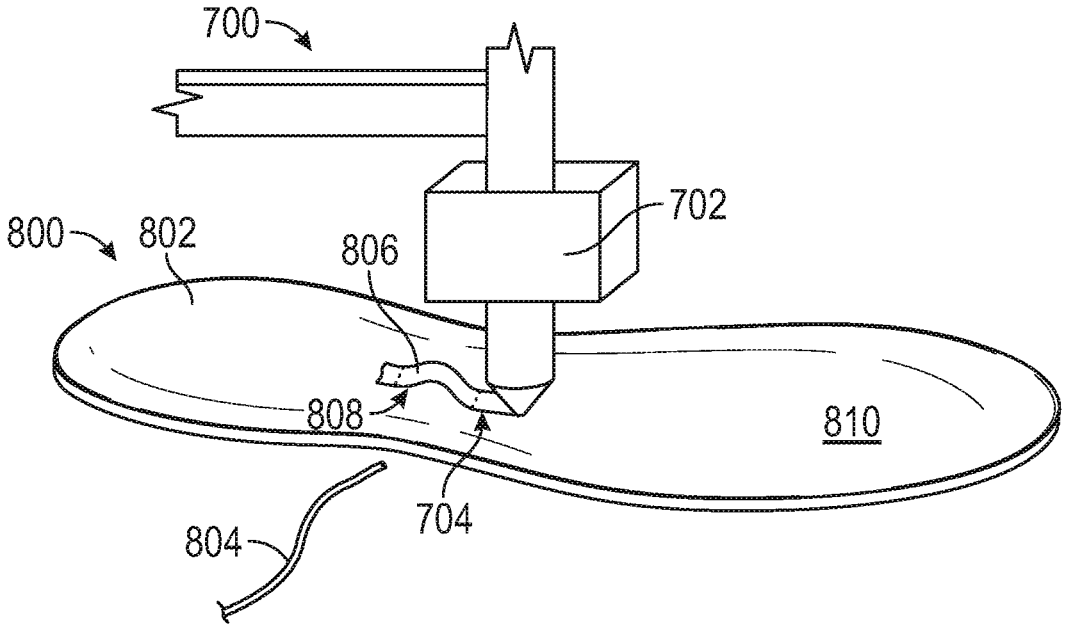
FIGS. 15A-15B depict an exemplary method of forming a guide structure for a sockliner assembly.
Figure 15B:
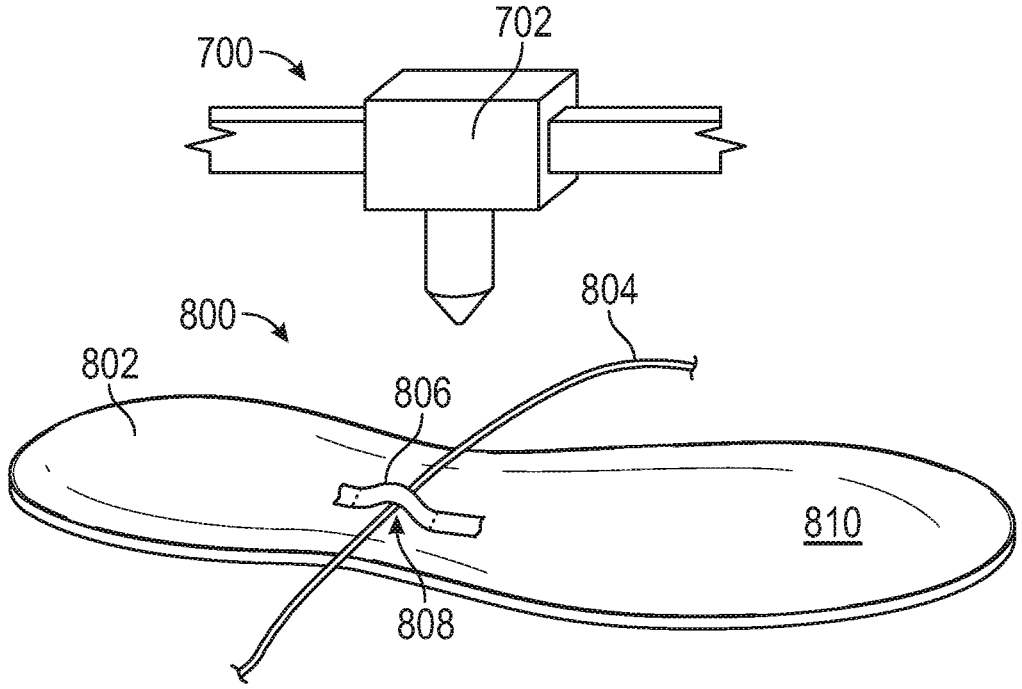

For example, FIGS. 15A-15B depict an exemplary method of forming a sockliner assembly 800 with a guide structure. The sockliner assembly 800 is like the sockliner assembly 400 in that the sockliner assembly 800 comprises a sockliner 802, one or more cables 804 (one shown in FIGS. 15A-15B), and one or more guide structures 806 (one shown in FIGS. 15A-15B). The guide structure 806 can comprise a passageway or lumen 808 configured for receiving the cable 804 and movably coupling the cable 804 to the sockliner 802.

The method can comprise using the printing device 700 to deposit the print material 704 from the print head 702 directly onto a surface 810 (e.g., a bottom surface) of the sockliner 802 to form the guide structure 806, as shown in FIG. 15A. Once the guide structure 806 is formed, the cable 804 can be inserted through the lumen 808 of the guide structure 806, as shown in FIG. 15B. Also, one or more portions of the cable 804 can be secured to the sockliner 802 by depositing the print material 704 onto the sockliner 802 and the cable 804 as described above with respect to FIGS. 14A-14B.

In some instances, the guide structures 422 of the sockliner assembly 400 can be formed using the method described above and depicted in FIGS. 15A-15B.

The print material 704 deposited by the print head 702 of the printing device 700 onto the sockliner assemblies can include one or more of TPU (e.g., NinjaFlex® manufactured by Fenner Drives, Inc.), TPE, and/or other print materials.

Additional Examples

Additional examples of the disclosed technology are enumerated below.

1. A sockliner assembly comprising:

a sockliner with an upper surface, an opposing lower surface, and a peripheral edge defining the upper and lower surfaces; and a first cable with a first attached cable segment and a first free cable segment, wherein the first attached cable segment is coupled to the lower surface of the sockliner, and wherein the first free cable segment extends from the first attached cable segment and extends beyond the peripheral edge of the sockliner.

2. The sockliner assembly according to example 1, further comprising a thermoplastic material coupled to the lower surface of the sockliner, wherein the first attached cable segment is coupled to the lower surface of the sockliner by the thermoplastic material.

3. The sockliner assembly according to example 2, wherein the sockliner is formed of a base material, the base material having a higher modulus of elasticity than the thermoplastic material.

4. The sockliner assembly according to example 2, wherein:

the thermoplastic material forms a guide structure attached to the sockliner, the guide structure including a lumen, the first cable includes a translatable cable segment, and the translatable cable segment can translate through the lumen of the guide structure.

5. The sockliner assembly according to any one of examples 1-4, wherein:

the sockliner includes an aperture that extends from the upper surface to the lower surface of the sockliner, the first attached cable segment is attached to the lower surface of the sockliner on a lateral side of the aperture, the first free cable segment extends along the lower surface of the sockliner from the lateral side of the aperture, across the aperture, and to a medial side of the aperture, and the aperture has a first width when the first cable is in an untensed configuration, and exerting a tensile force on the first free cable segment in a medial direction pulls the first attached cable segment in the medial direction and reduces a width of the aperture from the first width to a second width.

6. The sockliner assembly according to any one of examples 1-5, wherein the first cable further includes a second attached cable segment spaced along a length of the first cable from the first attached cable segment, the second attached cable segment being coupled to the lower surface of the sockliner, and wherein the first free cable segment is located between the first attached cable segment and the second attached cable segment such that the first free cable segment forms a loop between the first attached cable segment and the second attached cable segment.

7. The sockliner assembly according to any one of examples 1-6, wherein the sockliner is formed of a base material, and wherein the first cable is formed of a cable material, the cable material having a higher modulus of elasticity than the base material.

8. The sockliner assembly according to any one of examples 1-7, wherein the sockliner is formed of a base material and wherein the first cable is formed of a cable material, the cable material having a lower modulus of elasticity than the base material.

9. The sockliner assembly according to any one of examples 1-8, wherein the first cable includes a second free cable segment, the second free cable segment being spaced from the first free cable segment, wherein the first free cable segment of the first cable forms a first loop along a lateral side of the sockliner assembly, and wherein the second free cable segment of the first cable forms a second loop along a medial side of the sockliner assembly.

10. The sockliner assembly according to any one of examples 1-9, further comprising a second cable with a second attached cable segment and a second free cable segment, wherein the second attached cable segment is coupled to the lower surface of the sockliner, wherein the second free cable segment extends from the second attached cable segment and extends beyond the peripheral edge of the sockliner.

11. The sockliner assembly according to example 10, wherein:

the first cable includes a third attached cable segment, the third attached cable segment being spaced along a length of the first cable from the first attached cable segment, the third attached cable segment is coupled to the lower surface of the sockliner, the first free cable segment is located between the first attached cable segment and the third attached cable segment such that the first free cable segment forms a first loop between the first attached cable segment and the third attached cable segment, and the first loop extending beyond the peripheral edge on a lateral side of the sockliner, the second cable includes a fourth attached cable segment, the fourth attached cable segment being spaced along a length of the second cable from the second attached cable segment, the fourth attached cable segment is coupled to the lower surface of the sockliner, and the second free cable segment is located between the second attached cable segment and the fourth attached cable segment such that the second free cable segment forms a second loop between the second attached cable segment and the fourth attached cable segment, the second loop extending beyond the peripheral edge on a medial side of the sockliner.

12. A sockliner assembly comprising:

a sockliner with an upper surface, a lower surface, and a side surface extending between the upper and lower surfaces and defining a peripheral edge of the sockliner; and a first cable with a first attached cable segment and a first free cable segment, the first attached cable segment being coupled to the sockliner, the first free cable segment extending from the first attached cable segment and extending beyond the peripheral edge of the sockliner.

13. The sockliner assembly according to example 12, wherein the first attached cable segment of the first cable is coupled to the upper surface of the sockliner.

14. The sockliner assembly according to example 12 or example 13, wherein the first attached cable segment of the first cable is coupled to the lower surface of the sockliner.

15. The sockliner assembly according to any one of example 12-14, wherein the first attached cable segment of the first cable is coupled to the side surface of the sockliner.

16. The sockliner assembly according to any one of examples 12-15, further comprising a thermoplastic material coupled to the sockliner, wherein the first attached cable segment is coupled to the sockliner by the thermoplastic material.

17. The sockliner assembly according to example 16, wherein the sockliner is formed of a base material, the base material having a higher modulus of elasticity than the thermoplastic material.

18. The sockliner assembly according to example 16 or example 17, wherein:

the thermoplastic material forms a guide structure attached to the sockliner, the guide structure including a lumen, the first cable includes a translatable cable segment, and the translatable segment can translate through the lumen of the guide structure.

19. The sockliner assembly according to any one of examples 12-18, wherein:

the sockliner includes an aperture that extends from the upper surface to the lower surface of the sockliner, the first attached cable segment is attached to the lower surface of the sockliner on a lateral side of the aperture, the first free cable segment extends along the lower surface of the sockliner from the lateral side of the aperture, across the aperture, and to a medial side of the aperture, and the aperture has a first width when the first cable is in an untensed configuration, and exerting a tensile force on the first free cable segment in a medial direction pulls the first attached cable segment in the medial direction and reduces a width of the aperture from the first width to a second width.

20. The sockliner assembly according to any one of examples 12-19, wherein the first cable further includes a second attached cable segment spaced along a length of the first cable from the first attached cable segment, the second attached cable segment being coupled to the sockliner, and wherein the first free cable segment is located between the first attached cable segment and the second attached cable segment such that the first free cable segment forms a loop between the first attached cable segment and the second attached cable segment.

21. The sockliner assembly according to any one of examples 12-20, further comprising a second cable, wherein the second cable is coupled to the lower surface of the sockliner, and wherein the first cable is coupled to the upper surface of the sockliner.

22. An article of footwear comprising:

an upper, the upper including an interior void for receiving a foot;

a sole structure coupled to the upper; and a sockliner assembly dimensioned to fit within the interior void, the sockliner assembly being positioned adjacent to the sole structure, the sockliner assembly including:

a sockliner with an upper surface facing the interior void, an opposing lower surface facing the sole structure, and a peripheral edge defining the sockliner; and a first cable with a first attached cable segment and a first free cable segment extending from the first attached cable segment, wherein the first attached cable segment is coupled to the sockliner, wherein the first free cable segment is movable relative to the sockliner, and wherein at least a portion of the first free cable segment extends beyond the peripheral edge of the sockliner.

23. The article of footwear according to example 22, further comprising a thermoplastic material coupled to a lower surface of the sockliner, wherein the first attached cable segment is coupled to the lower surface of the sockliner by the thermoplastic material.

24. The article of footwear according to example 22 or example 23, wherein the first cable includes a second free cable segment, wherein the second free cable segment is spaced from the first free cable segment, wherein the first free cable segment of the first cable forms a first loop along a lateral side of the article of footwear, and wherein the second free cable segment of the first cable forms a second loop along a medial side of the article of footwear.

25. The article of footwear according to any one of examples 22-24, wherein the sockliner is non-destructively removable from the article of footwear.

26. The article of footwear according to any one of examples 22-25, wherein the first cable further includes a second attached cable segment, the second attached cable segment being spaced along a length of the first cable from the first attached cable segment, and the second attached cable segment being coupled to the sockliner, and wherein the first free cable segment is located between the first attached cable segment and the second attached cable segment such that the first free cable segment forms a loop extending between the first attached cable segment and the second attached cable segment.

27. The article of footwear according to example 26, wherein the upper further includes a first aperture that extends through the upper and a second aperture that extends through the upper, the second aperture being spaced apart from the first aperture, and wherein the first free cable segment passes from the interior void through the first aperture in the upper and the first free cable segment re-enters the interior void through the second aperture in the upper such that at least a portion of the loop is located outside of the interior void of the upper.

28. The article of footwear according to example 26, wherein the upper further includes a first aperture that extends through the upper; and wherein the first free cable segment passes from the interior void through the first aperture in the upper and the first free cable segment re-enters the interior void through the first aperture in the upper such that at least a portion of the loop is located outside of the interior void.

29. The article of footwear according to example 27 or example 28, further comprising a lace, and wherein the lace passes through the at least a portion of the loop.

30. A method of forming a sockliner assembly, the method comprising:

positioning a cable so that a first cable portion of the cable contacts a surface of a sockliner;

printing a print material onto the first cable portion and the sockliner; and curing the print material to attach the first cable portion to the sockliner.

31. The method according to example 30, further comprising:

positioning a second cable portion of the cable away from the sockliner, the second cable portion being spaced along a length of the cable from the first cable portion;

positioning a third cable portion of the cable so that the third cable portion of the cable contacts the surface of the sockliner, the third cable portion being spaced along the length of the cable from the second cable portion, the second cable portion being located between the first cable portion and the third cable portion;

printing the print material onto the third cable portion and the sockliner; and curing the print material to attach the third cable portion to the sockliner.

32. The method according to example 30 or example 31, wherein the print material includes a thermoplastic material.

33. A method of forming a sockliner assembly, the method comprising:

depositing a print material onto a surface of a sockliner, the print material forming a guide structure, and the guide structure including a passageway; and inserting a cable through the passageway of the guide structure.

34. The method according to example 33, further comprising:

positioning the cable so that a first cable portion of the cable contacts the surface of the sockliner, the first cable portion being spaced apart from the passageway;

depositing the print material onto the first cable portion and the sockliner; and curing the print material to attach the first cable portion to the sockliner.

35. The method according to example 34, further comprising:

positioning the cable so that a second cable portion of the cable contacts the surface of the sockliner, the second cable portion being spaced apart from the passageway;

depositing the print material onto the second cable portion and the sockliner; and curing the print material to attach the second cable portion to the sockliner.

36. The method according to example 35, wherein a third cable portion of the cable located between the first cable portion and the second cable portion can extend beyond a peripheral edge of the sockliner after the first cable portion and the second cable portion have been attached to the sockliner.

37. A sockliner assembly comprising:

a sockliner; and one or more straps extending from the sockliner, wherein tensioning the straps causes the sockliner bend from a first configuration to a second configuration.

38. The sockliner assembly according to example 37, wherein the straps have openings configured for receiving a lace of an article of footwear.

39. The sockliner assembly according to example 37 or example 38, wherein the straps are coupled to the sockliner with one or more of an adhesive, fasteners, stitching, and printed material.

40. The sockliner assembly according to example 37 or example 38, wherein the straps and the sockliner are integrally formed as a single, unitary component.

41. The sockliner assembly according to example 40, wherein the strap and the sockliner are formed by 3-D printing.

42. A cable connector for use with an article of footwear, the cable connector comprising:

one or more attachment portions, wherein the attachment portions are configured for attaching the cable connector to first portion of an article of footwear; and one or more support portions extending from the attachment portions, wherein the support portions are configured for receiving a second portion of the article of footwear.

43. The cable connector of example 42, wherein the attachment portions are eyelets, and wherein the first portion of the article of footwear is a lace.

44. The cable connector of example 42 or example 43, wherein the support portions are links, and wherein the second portion of the article of footwear is a cable or a strap of a sockliner assembly.

45. The cable connector of example 42 or example 43, wherein the support portions are links, and wherein the second portion of the article of footwear is a cable or a strap.

46. An article of footwear comprising:

an upper, the upper including an interior void for receiving a foot;

a sole structure coupled to the upper; and a sockliner assembly disposed within the interior void; and a cable connector connected to the upper and the sockliner assembly.

Any feature(s) of any example(s) disclosed herein can be combined with or isolated from any feature(s) of any example(s) disclosed herein, unless otherwise stated. For example, the attachment structures 420 and/or the guide structures 422 of the sockliner assembly 400 can be used on to attach the cable 104 to the sockliner 102 of the sockliner assembly 100. As another example, one or more steps of the methods of forming a sockliner described herein can be used to form any of the disclosed sockliners. As yet another example, one or more of the materials described with respect to the sockliner assembly 100 can be used for any one of the sockliner assemblies 400, 506, 600, and 800.

In view of the many possible embodiments to which the principles of the disclosure may be applied, it should be recognized that the illustrated embodiments are only examples and should not be taken as limiting the scope of the claims. Rather, the scope of the claimed subject matter is defined by the following claims and their equivalents.

The invention claimed is:

1. An article of footwear comprising:

an upper, the upper including an interior void for receiving a foot;

a sole structure coupled to the upper; and a sockliner assembly dimensioned to fit within the interior void, the sockliner assembly being positioned adjacent to the sole structure, the sockliner assembly including:

a sockliner formed of a flexible material and comprising an upper surface facing the interior void, an opposing lower surface facing the sole structure, and a peripheral edge defining the sockliner; and a first cable with a first attached cable segment and a first free cable segment extending from the first attached cable segment, wherein the first attached cable segment is coupled to the sockliner, wherein the first free cable segment is movable relative to the sockliner, wherein at least a portion of the first free cable segment extends from the lower surface of the sockliner, across the peripheral edge of the sockliner, and upwardly beyond the upper surface of the sockliner within the interior void of the upper, and wherein tensioning the first cable moves the sockliner upwardly relative to the sole structure such that there is a gap between the lower surface of the sockliner and the sole structure.

2. The article of footwear of claim 1, further comprising a thermoplastic material coupled to the lower surface of the sockliner, wherein the first attached cable segment is coupled to the lower surface of the sockliner by the thermoplastic material.

3. The article of footwear of claim 2, wherein the sockliner is formed of a base material, the base material having a higher modulus of elasticity than the thermoplastic material.

4. The article of footwear of claim 2, wherein:

the thermoplastic material forms a guide structure attached to the sockliner, the guide structure including a lumen, the first cable includes a translatable cable segment, and the translatable cable segment can translate through the lumen of the guide structure.

5. The article of footwear of claim 1, wherein the first cable further includes a second attached cable segment spaced along a length of the first cable from the first attached cable segment, the second attached cable segment being coupled to the lower surface of the sockliner, and wherein the first free cable segment is located between the first attached cable segment and the second attached cable segment such that the first free cable segment forms a loop between the first attached cable segment and the second attached cable segment.

6. The article of footwear of claim 1, wherein the sockliner is formed of a base material, and wherein the first cable is formed of a cable material, the cable material having a higher modulus of elasticity than the base material.

7. The article of footwear of claim 1, wherein the sockliner is formed of a base material, and wherein the first cable is formed of a cable material, the cable material having a lower modulus of elasticity than the base material.

8. The article of footwear of claim 1, wherein the first cable includes a second free cable segment, the second free cable segment being spaced from the first free cable segment, wherein the first free cable segment of the first cable forms a first loop along a lateral side of the sockliner assembly, and wherein the second free cable segment of the first cable forms a second loop along a medial side of the sockliner assembly.

9. The article of footwear of claim 1, wherein the at least a portion of the first free cable segment extends from the interior void of the upper through an opening in the upper, wherein the opening in the upper is spaced apart from the sole structure.

10. The article of footwear of claim 1, wherein the at least a portion of the first free cable segment directly contacts the peripheral edge of the sockliner.

11. An article of footwear comprising:

an upper, the upper including an interior void for receiving a foot;

a sole structure coupled to the upper; and a sockliner assembly dimensioned to fit within the interior void, the sockliner assembly being positioned adjacent to the sole structure, the sockliner assembly including:

a sockliner formed of a flexible material and comprising an upper surface facing the interior void, an opposing lower surface facing the sole structure, and a peripheral edge defining the sockliner; and a first cable with a first attached cable segment and a first free cable segment extending from the first attached cable segment, wherein the first attached cable segment is coupled to the sockliner, wherein the first free cable segment is movable relative to the sockliner, wherein at least a portion of the first free cable segment contacts the peripheral edge of the sockliner and extends upwardly away from the upper surface of the sockliner within the interior void of the upper, and wherein tensioning the first cable moves the sockliner upwardly relative to the sole structure such that there is a gap between the lower surface of the sockliner and the sole structure.

12. An article of footwear comprising:

an upper, the upper including an interior void for receiving a foot;

a sole structure coupled to the upper; and a sockliner assembly dimensioned to fit within the interior void, the sockliner assembly being positioned adjacent to the sole structure, the sockliner assembly including:

a sockliner formed of a flexible material and comprising an upper surface facing the interior void, an opposing lower surface facing the sole structure, and a peripheral edge defining the sockliner; and a first cable with a first attached cable segment and a first free cable segment extending from the first attached cable segment, wherein the first attached cable segment is coupled to the sockliner, wherein the first free cable segment is movable relative to the sockliner, wherein at least a portion of the first free cable segment extends from the peripheral edge of the sockliner and extends upwardly within the interior void of the upper relative to the upper surface of the sockliner, and wherein tensioning the first cable moves the sockliner upwardly relative to the sole structure such that a portion of the lower surface of the sockliner is spaced apart from the sole structure.

* * * * *